United States Patent [19]

Murthy et al.

[11] 4,446,012

[45] May 1, 1984

[54] PROCESS FOR PRODUCTION OF LIGHT HYDROCARBONS BY TREATMENT OF HEAVY HYDROCARBONS WITH WATER

[75] Inventors: Andiappan K. S. Murthy, Lake Hiawatha; Kundanbhai M. Patel, Landing; Alex Y. Bekker, Teaneck, all of N.J.

[73] Assignee: Allied Corporation, Morris Township, Morris County, N.J.

[21] Appl. No.: 517,311

[22] Filed: Jul. 26, 1983

Related U.S. Application Data

[63] Continuation-in-part of Ser. No. 450,710, Dec. 17, 1982, abandoned.

[51] Int. Cl.[3] ..... C10G 29/02; C10G 35/02; C07C 4/04

[52] U.S. Cl. ..... 208/130; 585/652

[58] Field of Search ..... 208/130, 8 R; 585/652

[56] References Cited

U.S. PATENT DOCUMENTS

| | | | |
|---|---|---|---|
| 1,851,093 | 3/1932 | Gensecke | 208/348 |
| 2,135,332 | 11/1938 | Gary | 208/130 |
| 3,983,027 | 9/1978 | McCollum et al. | 208/8 R |
| 4,113,446 | 9/1978 | Modell et al. | 252/373 |

OTHER PUBLICATIONS

Hosoi et al., "Ethylene from Crude Oil" Chem. Eng. Progress, v 71, No. 11, pp. 63–67, Nov. 1975.

*Primary Examiner*—Delbert E. Gantz
*Assistant Examiner*—Chong K. Pak
*Attorney, Agent, or Firm*—Thomas D. Hoffman; Gerhard H. Fuchs

[57] ABSTRACT

A process for converting heavy hydrocarbons into light hydrocarbons which comprises contacting, in a first zone, a heavy hydrocarbon having an API gravity at 25° C. of less than about 20, such as Boscan heavy crude oil and tar sand bitumen, with a liquid comprising water, in the absence of externally added catalyst and hydrogen, while maintaining the first zone at a temperature between about 380° and about 480° C. and at a pressure between about 5000 kPa (about 725 psig, about 49 atm) and about 15,000 kPa (about 2175 psig, about 148 atm), for a time sufficient to produce a uniform reaction mixture; forwarding the uniform reaction mixture to a second zone wherein the temperature and pressure conditions of the first zone are maintained for a time sufficient to separate the uniform mixture into a residue and a phase comprising light hydrocarbons, gas and water, withdrawing the residue and said phase from the second zone; and recovering a light hydrocarbon product having an API gravity at 25° C. of greater than about 20 and substantially free of vanadium and nickel values, i.e., less than 50 ppm, preferably less than 30 ppm, a gaseous product, and a residue is disclosed.

22 Claims, 4 Drawing Figures

VANADIUM AND NICKEL CONCENTRATION IN EXTRACT AS A FUNCTION OF PRESSURE IN WATER TREATMENT OF BOSCAN HEAVY OIL AT 410°C
VANADIUM
NICKEL
VANADIUM OR NICKEL IN THE EXTRACT (wt ppm)
180
160
140
120
100
80
60
40
20
500
1000
1500
2000
2500
3000
3500
PRESSURE (psi)

VISCOSITY (CENTIPOISE) AND API GRAVITY OF EXTRACT AS A FUNCTION OF PRESSURE IN WATER TREATMENT OF BOSCAN AT 410°C

PROCESS FOR PRODUCTION OF LIGHT HYDROCARBONS BY TREATMENT OF HEAVY HYDROCARBONS WITH WATER

CROSS-REFERENCE TO RELATED APPLICATION

This is a continuation-in-part application of U.S. patent application Ser. No. 450,710, filed Dec. 17, 1982, now abandoned.

BACKGROUND OF THE INVENTION

The present invention relates to a process for treating heavy hydrocarbons with water to form light hydrocarbons, a gaseous product and a residue. More particularly, the present invention is directed to a process for treating heavy hydrocarbons containing organometallics, for example vanadium and nickel, organosulfur and organonitrogen compounds, and asphaltenes with water at elevated temperatures and pressures, in the absence of externally added catalyst and hydrogen, for a time sufficient to form a light hydrocarbon product, substantially free of vanadium and nickel, a gaseous product and a residue.

There exist enormous quantities of heavy hydrocarbons such as heavy petroleum crude oils and tar sand bitumen (the heavy hydrocarbons extracted from tar sands), as well as residual heavy hydrocarbon fractions obtained from heavy hydrocarbon crudes such as atmospheric tower bottoms products, vacuum tower bottoms products, crude oil residuum and heavy vacuum gas oils. These heavy crude and residual hydrocarbon streams contain large amounts of organometallic compounds, especially those containing nickel and vanadium, organosulfur and organonitrogen compounds, and asphaltenes (high molecular weight polycyclic, pentane insoluble materials). In addition, these heavy crude and residual hydrocarbons are viscous and as such require a greater degree of processing to convert them into liquid materials that can be transported easily.

A number of alternate physical and chemical routes have been and are still being developed for converting heavy hydrocarbon materials into lighter liquid and gaseous fuels. Among the approaches are physical separation processes such as vacuum distillation, steam distillation, and solvent deasphalting, various thermal conversion processes such as visbreaking, delayed coking, fluid coking and coke gasification, catalytic processes such as hydrotreating, hydrorefining and hydrocracking, as well as multistage catalytic and noncatalytic processes. Each of these approaches has one or more drawbacks. In physical separation processes such as vacuum distillation, steam distillation and solvent deasphalting, a liquid hydrocarbon fraction is recovered in low yield but the asphaltene and resinous materials are not converted into product and must be disposed of separately. The various thermal conversion processes such as visbreaking, delayed coking, fluid coking and coke gasification require high temperatures above 500° C. and generate a low quality by-product coke. In coke gasification, treatment of heavy hydrocarbons with steam and oxygen at high temperatures is necessary to produce a product gas, which must be utilized locally, and a limited yield of lighter liquid hydrocarbon product. Recently, a thermal conversion process called the Eureka process was disclosed in Chemical Engineering Progress, February 1981, pages 37–44 and in U.S. Pat. No. 4,242,196. The Eureka process converts petroleum residues, such as mixtures of vacuum residues from Khafij crude oil, or Iranian heavy crude oil, into a low sulfur petroleum oil and petroleum pitch by preheating the mixture of vacuum residues to about 450° to 520° C., feeding the preheated mixture to a fractionator and then to a charge heater at 500° C. before stripping the thermally cracked low molecular weight hydrocarbons with superheated steam in a delayed coker reactor at 420°–430° C. under atmospheric pressure. Catalytic hydrogenation processes such as hydrotreating, hydrorefining, and hydrocracking may be used for converting heavy hydrocarbon feedstocks into a good quality material in high yield. However the hydrogenation catalyst employed in each of these processes is rapidly poisoned by the exceedingly large amounts of organometallic compounds and asphaltenic material in the heavy hydrocarbon feedstocks. The high levels of organometallic compounds in the feedstocks interfere considerably with the activity of the catalyst with respect to destructive removal of nitrogen and sulfur and oxygenated compounds such that the consumption of more than 3 kilograms of catalyst per 1000 kilograms of oil processed is normally required.

The prior art has also converted organic heavy hydrocarbons and other organic liquids to fuels by reaction with water. U.S. Pat. No. 4,113,446 (Modell et al.) discloses that liquid or solid organic materials can be converted into high BTU gas, with little or no formation of undesirable char or coke, when organic material is reacted with water at a temperature at or above the critical temperature of water and at or above the critical pressure of water to achieve the critical density of water. While U.S. Pat. No. 4,113,446 discloses that the process may be conducted either in the presence or absence of a catalyst, only gas and no liquid hydrocarbon fractions are recovered. International Publication No. WO 81/00855 (corresponding to U.S. patent application Ser. No. 079,534, filed Sept. 29, 1979 by M. Modell) discloses that organic solid or liquid material is admixed with water (in the region of the critical density of water, i.e., densities of water from 0.2 to 0.7 gms/cm$^3$) at pressures from 200–2500 atmospheres and at temperatures from 374° C. to at least about 450° C. to restructure the organic materials to form useful volatile organic liquids.

U.S. Pat. No. 3,983,027 (McCollum et al.) discloses a process for cracking, desulfurizing and demetallizing heavy hydrocarbon feedstocks such as vacuum gas oil, tar sand oils and atmospheric residual oils to produce gases, liquids (heavy ends and light ends), and a solid residue by contacting the heavy hydrocarbons with a dense-water containing fluid at a temperature in the range of 349° C. to 400° C. (660°–752° F.) and at a pressure in the range of 2500 psig to 4400 psig in the absence of an externally supplied catalyst and hydrogen or other reducing gas. The density of water in the dense-water containing fluid was at least about 0.1 g/mL, and sufficient water was present to serve as an effective solvent for recovered liquids and gases. However, in the examples which disclose a process for removal of vanadium and nickel, straight tar sands having no more than 256 ppm of vanadium and nickel were treated with water at 400° C. and 4100–4350 psig for at least one hour. To produce a hydrocarbon product having an API density of 21 and low (10 ppm) nickel and vanadium content, the presence of alundum balls in the reaction zone at 400° C. and 4100 psig and extremely low flow rates (1 mL of tar sands and oil per hour) were required. In another example run under identical conditions except that the flow rate was 2 mL/hour, the hydrocarbon product had an API density of 17.8 and an unacceptably higher (77 ppm) nickel and vanadium content.

U.S. Pat. No. 2,135,332 (Gary) discloses a process for the cracking of relatively heavy oil, such as reduced crude, other heavy oils of residual nature or a heavy gas oil consisting principally of constituents boiling above 700° F. to produce gases, liquids (lower boiling hydrocarbons of the gasoline range) and a solid or liquid residue including coke by admixing the heavy oil with a diluent such as steam, low boiling hydrocarbon gases or fixed gases at temperatures in the range of 650°-975° F. (343°-524° C.) and at pressures as low as 300 lbs/sq in, preferably in the neighborhood of 2,000-3,000 lbs/sq in. Gary discloses the admixture is treated in three coils in a furnace; the admixture is preheated to a temperature just below the cracking temperature, such as 650°-700° F. (343°-371° C.), followed by passing the preheated mixture to a zone wherein it is rapidly heated to a temperature in excess of 900° F. (>482° C.) followed by heating in another portion of the furnace at a temperature below the cracking temperature wherein the desired conversion is carried to completion. The converted products from the furnace are passed through a pressure letdown valve and forwarded thence to an evaporator where vapors separate from a residue which may be solid coke or liquid. In the evaporator the residue is separated from the vapors and the vapors are forwarded to a fractionation zone to separate out the higher boiling components and recover liquid boiling in the gasoline range. Further, Gary discloses that coke is formed within the heating coil by conversion of heavy asphaltenes and viscous materials due to the higher temperature and prolonged heating within the heating zone, but that less coking difficulties are encountered within the heating coil when operating under his high temperature (>480° C.) and high pressure (2000-3000 psi) conditions than are encountered under low temperature, low pressure conditions. However, Gary does not suggest a method of converting heavy oil containing high metal values, e.g., nickel and vanadium, into a light hydrocarbon oil substantially free of such metal values.

In addition, there are various catalytic processes for treating heavy hydrocarbons with water with specific externally supplied catalyst systems and externally supplied hydrogen at specified temperatures above the critical temperature of water and at specified pressures, from below to above the critical pressure of water.

SUMMARY OF THE INVENTION

It has been discovered that heavy hydrocarbons feedstocks containing vanadium and nickel values, may be converted into light hydrocarbon products substantially free of vanadium and nickel values by contacting the heavy hydrocarbon feedstocks with water, in the absence of externally added catalyst and hydrogen, at selected pressure and temperature ranges. The pressure range selected to produce a light hydrocarbon product substantially free of vanadium and nickel values depended upon the heavy hydrocarbon feedstock; thereafter, temperature range was selected to provide a sufficient quantity of light hydrocarbon product at acceptable reaction rates while avoiding coke formation. Accordingly, the present invention provides a process for converting heavy hydrocarbons into light hydrocarbons which comprises:

(a) contacting, in a first zone, heavy hydrocarbons having an API gravity at 25° C. of less than about 20 with a liquid comprising water, in the absence of externally added catalyst and hydrogen, at a temperature between about 380° C.-480° C. and at a pressure between about 5000 kPa (about 725 psig, about 49 atm) and about 15,000 kPa (about 2175 psig, about 148 atm), and for a time sufficient to form a uniform mixture;

(b) forwarding the uniform mixture to a second zone while maintaining the temperature and pressure conditions of the first zone;

(c) maintaining the uniform mixture in the second zone under the temperature and pressure conditions of the first zone, in the absence of externally added catalyst and hydrogen, for a time sufficient to separate the uniform mixture into a residue and a phase comprising light hydrocarbons, gas and water;

(d) withdrawing the residue and said phase from the second zone;

(e) separating said phase into a gaseous product, a liquid comprising water, and light hydrocarbon product having an API gravity at 25° C. of greater than about 20 and substantially free of vanadium and nickel values; and (f) recovering said light hydrocarbon product.

The present invention also provides a process for converting heavy hydrocarbons into light hydrocarbons which comprises:

(a) contacting, in a first zone, heavy hydrocarbons having an API gravity at 25° C. of less than about 20 and a total vanadium and nickel content between about 1000 and 2000 ppm with a liquid comprising water, in the absence of externally added catalyst and hydrogen, at a temperature between about 380° C. and about 480° C., and at a pressure between about 5000 kPa (about 725 psig, about 49 atm) and about 15,000 kPa (about 2175 psig, about 148 atm) for a time sufficient to form a uniform mixture;

(b) forwarding the uniform mixture to a second zone while maintaining the temperature and pressure conditions of the first zone;

(c) maintaining the uniform mixture in the second zone under the temperature and pressure conditions of the first zone, in the absence of externally added catalyst and hydrogen, for a time sufficient to separate the uniform mixture into a residue and a phase comprising light hydrocarbons, gas and water;

(d) withdrawing the residue and said phase from the second zone;

(e) separating said phase into a gaseous product, a liquid comprising water, and light hydrocarbon product having an API gravity at 25° C. of between about 20 and 40 and substantially free of vanadium and nickel values; and (f) recovering said light hydrocarbon product.

The present invention still further provides a process for converting heavy hydrocarbons into light hydrocarbons which comprises:

(a) contacting, in a first zone, heavy hydrocarbons having an API gravity at 25° C. of less than about 20 and a total vanadium and nickel content of between about 100 and 1000 ppm with a liquid comprising water, in the absence of externally added catalyst and hydrogen, at a temperature between about 380° and 480° C. and at a pressure between about 5000 kPa (about 725 psig, about 49 atm) and about 15,000 kPa (about 2175 psig, about 148 atm) for a time sufficient to form a uniform mixture;

(b) forwarding the uniform mixture to a second zone while maintaining the temperature and pressure conditions of the first zone;

(c) maintaining the uniform mixture in the second zone under the temperature and pressure conditions of the first zone, in the absence of externally added catalyst and hydrogen, for a time sufficient to separate the uniform mixture into a residue and a phase comprising light hydrocarbons, gas and water;

(d) withdrawing the residue and said phase from the second zone;

(e) separating said phase into a gaseous product, a liquid comprising water, and light hydrocarbon product having an API gravity at 25° C. of between about 20 and 40 and substantially free of vanadium and nickel values; and (f) recovering said light hydrocarbon product.

DETAILED DESCRIPTION OF THE INVENTION AND OF THE PREFERRED EMBODIMENTS

Figure 1:
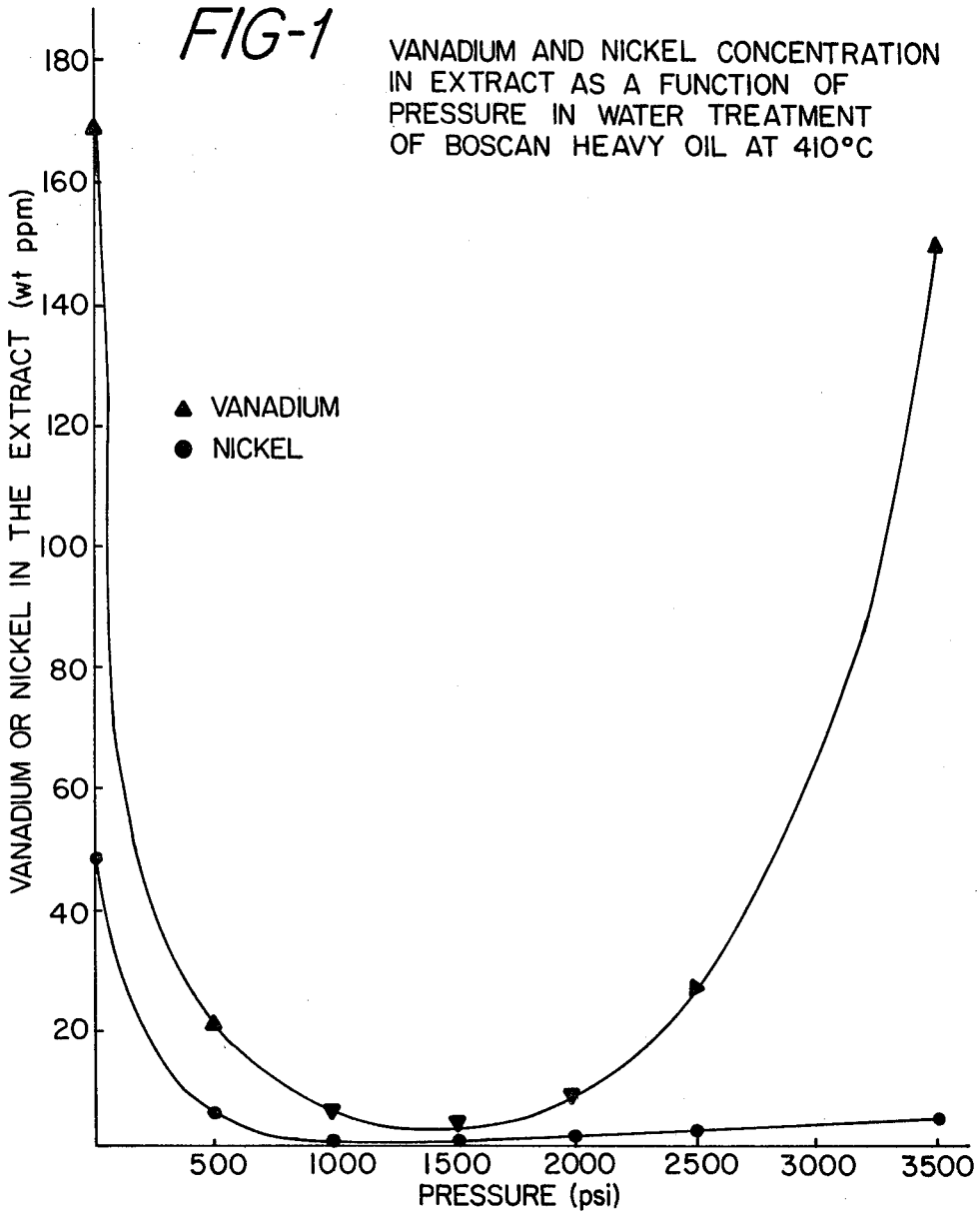
FIG. 1 graphically displays the variation of the vanadium and nickel concentration in the light hydrocarbon product obtained by treatment, in a semi-continuous reactor, of a Boscan heavy oil with water at 410° C. as a function of pressure.
Figure 2:
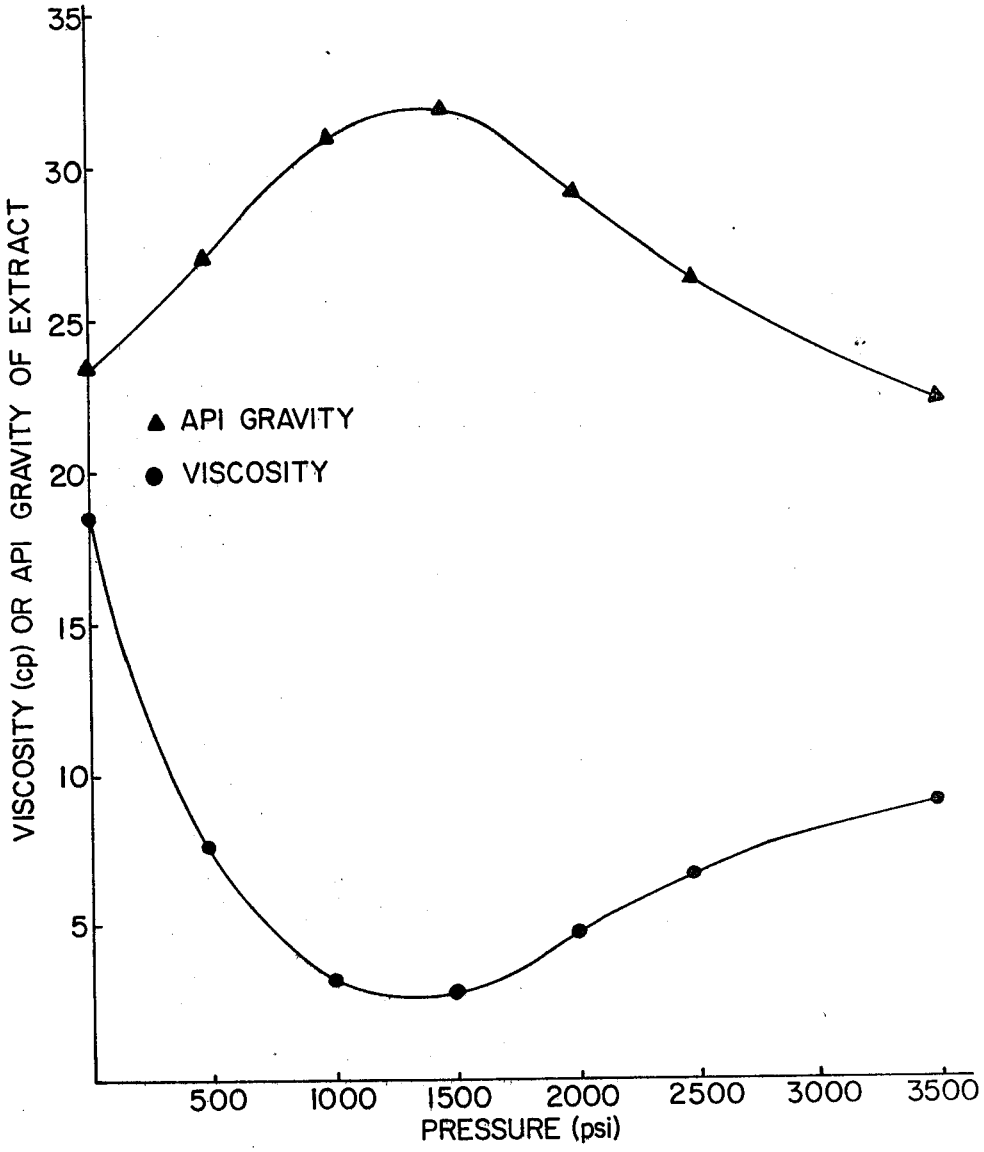
FIG. 2 graphically displays the variation of the API gravity and viscosity (at 25° C.) of the light hydrocarbon product obtained by treatment, in a semi-continuous reactor, of a Boscan heavy oil with water at 410° C. as a function of pressure.

In accordance with the present invention, heavy hydrocarbons having an API gravity at 25° C. of less than about 20 are treated with water under elevated temperature and pressures in the absence of externally added catalyst and/or hydrogen to produce a light hydrocarbon product having an API gravity at 25° C. of greater than about 20 and substantially free of vanadium and nickel values. The light hydrocarbon product, substantially free of vanadium and nickel values, has a carbon number distribution similar to that of gasoline, kerosene and diesel oil and as such can be catalytically reformed, at low catalyst consumption rates, into kerosene, diesel oil and gasoline, compared to heavy hydrocarbon feedstocks. By the term "substantially free of vanadium and nickel values" is meant a light hydrocarbon product containing generally less than about 50 ppm of vanadium and nickel values and as such suitable for catalyic reforming, at low catalyst consumption rates, compared to heavy hydrocarbon feedstocks. In addition, the light hydrocarbon product has a lower specific gravity (API gravity at 25° C. greater than about 20), a lower viscosity and is usually substantially free of nitrogen and usually contains only about 75% of the sulfur contained in the heavy hydrocarbon starting material. Surprisingly, it was discovered that the concentration of the vanadium and nickel in, and the values of the specific gravity and viscosity for the light hydrocarbon product were minimized by operating within the pressure range of the process of the present invention; See FIGS. 1 and 2. As additional advantages of the present invention, there is produced a minimum amount of gaseous product as well as a residue that is usually soluble in the heavy hydrocarbon starting material and that contains no coke or pitch which would interfere with the operation of the present invention. All of these advantages are achieved by the process of the present invention in the absence of externally added catalyst and/or hydrogen.

The temperature of the first and second zones is between about 380° and about 480° C., preferably between about 400° and about 470° C. and more preferably between about 430° and 460° C. The pressure of the first and second zones is between about 5000 kPa (about 725 psig, about 49 atm) and about 15,000 kPa (about 2175 psig, about 148 atm), preferably between about 7,000 kPa (about 1015 psig, about 69 atm) and about 13,000 kPa (about 1885 psig, about 128 atm) and more preferably between about 9000 kPa (about 1305 psig, about 89 atm) and 13,000 kPa (about 1885 psig, about 128 atm).

It is a feature of the present invention that the range of temperature and pressure recited hereinabove is maintained in both the first and second zones. In the first zone the heavy hydrocarbons are contacted with a liquid comprising water under temperature and pressure conditions and for a time sufficient to form a uniform mixture. The uniform mixture is forwarded to a second zone while maintaining the temperature and pressure conditions of the first zone. In the second zone the uniform mixture is maintained under temperature and pressure conditions of the first zone for a time sufficient to separate the uniform mixture into a residue and a phase comprising light hydrocarbons, gas and water. It is a special feature of the present invention that the separation step is effected while maintaining the temperature and pressure conditions of the first zone in the second zone. The residue and the phase in the form of vapors comprising light hydrocarbons, gas and water are withdrawn from the seoond zone at the temperature and pressure of the first zone. In a preferred embodiment of the present invention, the phase comprising the vapor phase withdrawn from the second zone is separated into a gaseous product, a liquid comprising water and light hydrocarbon products, and the liquid hydrocarbon product is recovered. In another preferred embodiment of the present invention, the separation of the vapor phase into its components is effected by reducing the pressure and temperature of the second zone to values sufficient to allow phase separation. In another preferred embodiment of the present invention, the phase separation is effected at the temperature and pressure values maintained in the second zone and only after the liquid hydrocarbons are removed from the gas and the liquid comprising water is the pressure and temperature reduced to ambient values.

By the term "uniform mixture" as used herein, is meant an emulsion, or a solution of vapors in liquid or of vapors in vapor or liquid in liquid or any mixture thereof sufficient to provide intimate contacting so as to facilitate conversion of the heavy hydrocarbons into light hydrocarbon product.

By the term "phase" as used herein to describe the phase comprising the liquid hydrocarbons, gas and water that are formed and removed from the second zone, is meant a mixture of vapor and liquid or vapor, gas and liquid or all vapors.

Surprisingly, when the heavy hydrocarbons were treated with water at between 370° and 460° C. and at atmospheric pressure, the atmospheric steam distillation process produced only a small amount of hydrocarbon extract having a high (50–200 ppm) vanadium and nickel. When the heavy hydrocarbons were treated in the semi-continuous reactor with water at 410° C. and pressures in excess of 15,000 kPa (2175 psig), such as 17,238 kPa (2500 psig), a higher yield of light hydrocarbons (about 72%) was obtained than when the pressure was maintained at no more than about 13,782 kPa (about 2000 psig). However, when a heavy hydrocarbon, Boscan heavy crude oil, was treated with water at 410° C. and at a preferred range pressure of about 9000 kPa to 13,000 kPa (1305 psig to about 1885 psig), a light hydrocarbon product was obtained containing less vanadium and nickel and having a lower viscosity and density (the inverse of API gravity) than the light hydrocarbon produced when the heavy hydrocarbon Boscan heavy oil was treated with water, in a semi-continuous reactor at 410° C. and at pressures greater than 15,000 kPa (2175 psig), for example 17,235 to 24,129 kPa (2500 to 3500 psig). The results (illustrated in FIG. 1) of the variation of the vanadium and nickel concentration in light hydrocarbon product obtained by treatment of Boscan heavy oil with water in a semi-continuous reactor at 410° C. under varying pressure conditions are expected to be similar if Boscan heavy oil or tar sand bitumen were treated with water in the flow reactor illustrated in FIG. 3 or 4. Similarly, the results (illustrated in FIG. 2) of the variation of the API gravity and viscosity (25° C.) of the light hydrocarbon product obtained by treatment of Boscan heavy oil with water in a semi-continuous reactor at 410° C. under varying pressure conditions are expected to be similar if Boscan heavy oil or tar sand bitumen were treated with water in the flow reactor illustrated in FIG. 3 or 4.

The water to oil volume ratio may be varied from about 1:2 to about 10:1, preferably about 1:1 to about 3:1 and more preferably about 1:1.

The process of the present invention operates in the absence of externally added catalyst and/or hydrogen; only the hydrogen provided from the water in the absence of externally added catalyst is required for the process of the present invention. In some instances it may be desirable to provide the first and/or second zones with a packed bed of inert materials such as particles of granite, sand, porcelain or bed saddles. The use of inert materials in first and/or second zones is not critical to operation of the present invention. In addition, it is preferable to operate the process of the present invention in an atmosphere substantially free of gases such as oxygen which may interfere with the process of the present invention. However, the presence of small amounts of air are not detrimental to the process of the present invention.

Deuterium labeling experiments were conducted by treatment of heavy hydrocarbons such as Boscan heavy oil with deuterium oxide under conditions of the present invention. Extensive incorporation of deuterium into the light hydrocarbon and gaseous products and residue was observed. Based on chemical spectral analysis of the deuterated light hydrocarbon and gaseous products, some chemical restructuring of the heavy hydrocarbon feed occurred during the course of the process of the present invention. However, at least some of the hydrogen-deuterium exchange observed might also have occurred after the product was formed. Apparently, water was a reactant and not merely a solvent in the process of the present invention.

The process of the present invention operates with heavy hydrocarbons having an API gravity at 25° C. of less than about 20. Among the heavy hydrocarbons found useful in the process of the present invention are heavy crude oil, heavy hydrocarbons extracted from tar sands, commonly called tar sand bitumen, such as Athabasca tar sand bitumen obtained from Canada, heavy petroleum crude oils such as Venezuelan Orinoco heavy oil belt crudes (Boscan heavy oil), heavy hydrocarbon fractions obtained from crude petroleum oils particularly heavy vacuum gas oils, vacuum residue as well as petroleum tar and coal tar. The viscosity measured at 25° C. of the heavy hydrocarbon feedstock material may vary over a wide range from about 1,000 to about 100,000 cp, normally 20,000 cp to about 65,000 cp. In a preferred embodiment of the present invention Boscan heavy oil having a viscosity of about 60,000 cp at 25° C. was treated with water at 410° C. and 6,894 to 13,788 kPa (1,000 to 2,000 psig) to produce a light hydrocarbon product having a viscosity at 25° C. less than about 10 cp. In another preferred embodiment of the present invention tar sand bitumen having a viscosity of about 30,000 cp at 25° C. was converted by treatment with water at 410° C. and 6,894 to 13,788 kPa (1,000 to 2,000 psig) into light hydrocarbon product having a viscosity at 25° C. less than about 10 cp. Among the organometallic compounds found in the heavy hydrocarbons, nickel and vanadium are most common although other metals including iron, copper, lead and zinc are also often present. In a preferred embodiment of the process of the present invention heavy hydrocarbons having an API gravity at 25° C. of less than about 20 and a total vanadium and nickel content between 1,000 and 2,000 ppm was converted into light hydrooarbons having an API gravity of 25° C. of between about 20 and 40 and a total vanadium and nickel content less than about 50 preferably less than about 30 ppm. In another preferred embodiment of the present invention heavy hydrocarbons having an API gravity at 25° of less than about 20 and a total vanadium and nickel content of between about 100 and 1000 ppm were converted into light hydrocarbon product having a API density at 25° between about 20 and 40 and a total vanadium and nickel content less than about 50 ppm preferably less than about 30 ppm.

By the term "light hydrocarbon product" as used herein is meant a hydrocarbon having an API gravity at 25° C. of greater than about 20 preferably between about 20 and about 40. The light hydrocarbon product obtained in accordance with the process of the present invention has a total vanadium and nickel content generally of less than about 50 ppm, preferably less than about 30 ppm and is usually substantially free of organonitrogen compounds and usually contains only about 75% of the organosulfur compounds present in the starting heavy hydrocarbons. The viscosity of the light hydrocarbon product at 25° C. is less than about 10 cp, preferably less than about 5 cp. The hydrocarbon to carbon ratio of the light hydrocarbon is higher than the hydrogen to carbon ratio of the heavy hydrocarbons. In a preferred embodiment of the present invention, the heavy hydrocarbon, Boscan heavy oil having a hydrogen-carbon ratio equal to about 1.5 was treated with water at 410° C. and 10,342 kPa (1500 psig) to produce a light hydrocarbon product having a hydrogen-carbon ratio of about 1.7. By gas chromatographic analysis, the weight distribution of carbon units in the light hydrocarbon product having the H/C ratio of 1.7 was approximately the same as that found in gasoline, kerosine and diesel oil.

The gaseous product obtained by treatment of the heavy hydrocarbons in accordance with the process of the present invention comprises carbon dioxide, hydrogen sulfide and $C_1$–$C_6$ alkenes and alkanes as well as a trace amount of hydrogen. The amount of the gaseous product obtained is preferably no more than about 10 weight %, and preferably is less than about 5 weight %, basis starting heavy hydrocarbons.

The residue obtained by treatment of the heavy hydrocarbons in accordance with the process of the present invention is usually soluble in the feedstock heavy hydrocarbons. This residue is not a coke or pitch and as such may be used as a source of fuel, may be recycled or may be treated with steam or lower hydrocarbons such as pentane to remove light hydrocarbons that may be entrapped therein.

The fluid comprising water may be tap water, river water, lake water or the like and may contain small amounts of salts accompanying the crude oil as obtained from the ground. While the presence of salt in the water may be tolerated, a salt concentration of greater than about 100 ppm is objectionable and is to be avoided.

The process of the present invention may be carried out either as a semi-continuous or batch process or as a continuous process. In the continuous process both the heavy hydrocarbons and water are fed under pressure to a preheated first zone wherein the temperature and pressure conditions are maintained for a time sufficient to form a uniform mixture which is forwarded to the second zone wherein the temperature and pressure conditions of the first zone are maintained for a time sufficient to separate the uniform mixture into a residue and a phase containing the light hydrocarbon and gaseous products; the phase is continuously removed from the second zone while the residue stream is continuously or periodically removed from the second zone. The residence time in the first and second zones may be varied from a few minutes up to about 20 minutes, depending upon characteristics of heavy hydrocarbon feedstock and light hydrocarbon product desired. In the batch process a total residence time of about 10–20 minutes, preferably about 10 minutes, is used. In the continuous process, a total residence time of a few minutes to 20 minutes, preferably about 1 minute to less than about 3 minutes is used. In a continuous process, less gas is obtained than in the semi-continuous or batch process; less than about 10 weight %, preferably less than about 5 weight % and usually less than about 2 weight % of the total products are produced as gas in the continuous process.

Figure 3:
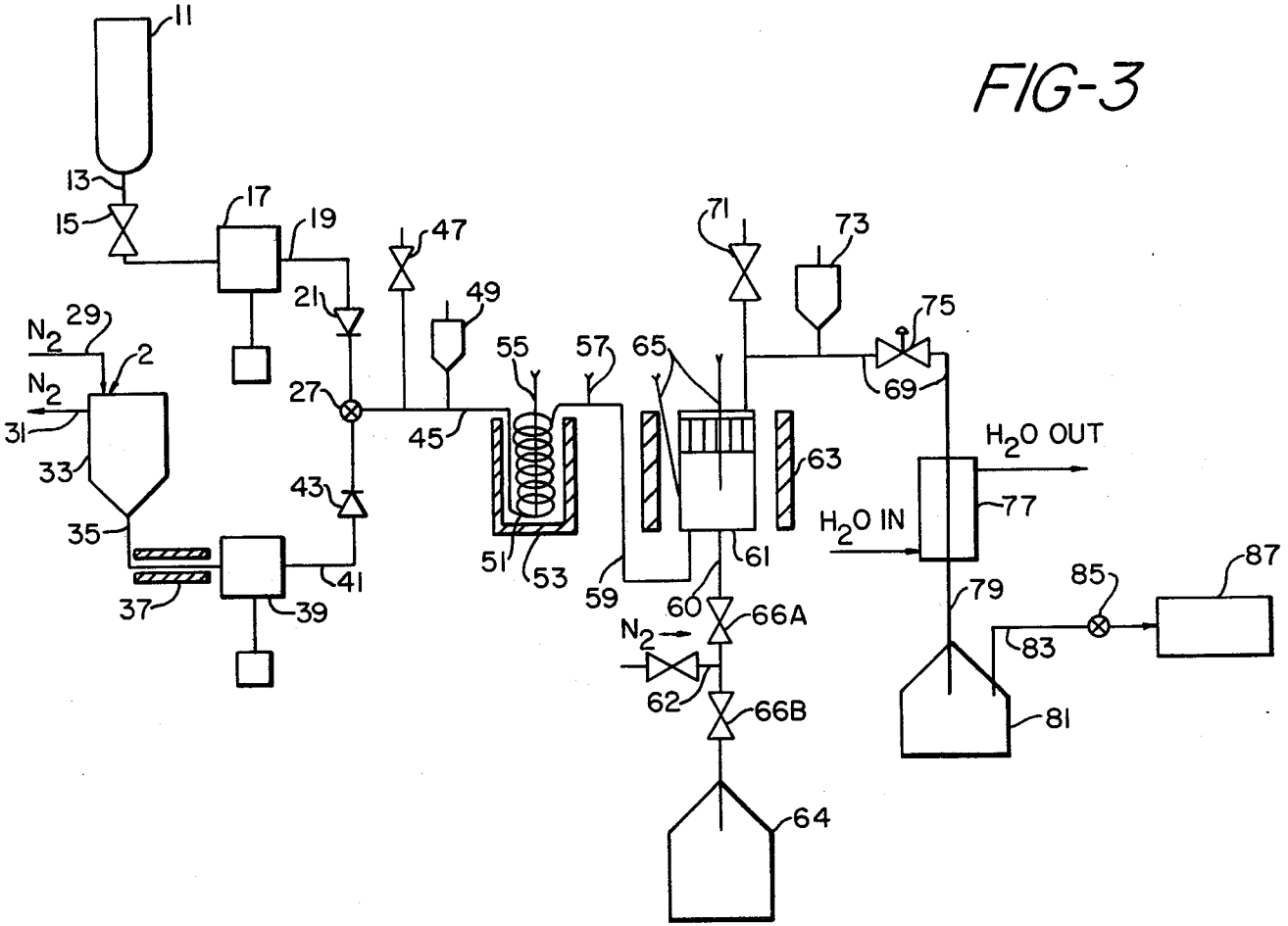
FIG. 3 is a schematic of a preferred embodiment of the process of the present invention operated in a flow reactor.

A preferred embodiment of the reaction of the present invention practiced in a continuous flow reactor is illustrated in FIG. 3. Water in storage vessel 11 is passed via line 13 through valve 15 to high pressure piston pump 17 through line 19 containing check valve 21 to valve 27. Storage vessel 33 equipped with heavy hydrocarbon feed line 2 pressurized with nitrogen via line 29 and a safety valve in line 31 is passed via line 35 equipped with heating tape 37 to high pressure gear pump 39 and then through line 41 check valve 43 to valve 27. In order to promote intimate contact between the heavy hydrocarbon and the water, the water from line 19 and the heated heavy hydrocarbon from line 41 are continuously fed through valve 27 into line 45 which may be equipped with a spiral stirrer to produce small droplets on the order of submicrons to about several microns of heavy hydrocarbon in the water. The intimate mixture in line 45 equipped with pressure transducer 49 is continuously fed to a spiral or tubular heater 51 immersed in the fluidized sand bath 53 equipped with thermocouple 55. The residence time in the heater 51 is preferably less than about 1 minute, more preferably on the order of about 10 seconds. The intimate heated uniform mixture of heavy hydrocarbon and water is passed via line 59 containing thermocouple 57 to high pressure autoclave 61 equipped with heating jacket 63, thermocouples of 65 and safety valve 71. The residence time in the high pressure autoclave is from a few seconds up to about 20 minutes. The light hydrocarbon stream and the gaseous stream produced from the intimate contact in high pressure autoclave 61 are continuously removed via line 69 containing pressure transducer 73, air operated pressure control valve 75 to condenser 77 which may be of any convenient design. From condenser 77, the light hydrocarbon and the gaseous streams are passed via line 79 to product receiver 81 for separation of the light hydrocarbon stream from the gaseous stream. The gaseous stream is removed via line 83 containing volumetric flowmeter 85 to gas storage container 87. Residue is periodically removed via line 60 to valves 66A and 66B equipped with line 62 to residue container 64.

It is a special feature of the process of the present invention that, in the second zone, the residue is separated from the vapor phase comprising light hydrocarbons, gas, and water while maintaining the pressure and temperature conditions of the first zone; the residue and vapor phase are withdrawn from the second zone and thereafter the pressure and temperature were reduced to values sufficient to allow recovery of the residue and separation of the vapor phase into a gaseous product, a liquid comprising water and a light hydrocarbon product having the desired properties.

By maintaining the pressure and temperature conditions of the first zone in the second zone for a time sufficient to effect separation and withdrawal of the residue and vaporous mixture, the residue is obtained substantially free of coke which would interfere with operation of the process of the present invention. In comparative example, Boscan heavy oil was continuously treated with water at 465°–470° C. and 2000 psig in a heating coil similar to that of U.S. Pat. No. 2,135,332 at varying residence times and the pressure and temperature reduced to ambient to form a reaction mixture which was thereafter distilled under vacuum to recover light hydrocarbon product. However, when the residence time was increased to provide greater than 50% up to 76% by weight of light hydrocarbons product, the heating coil became plugged with coke and the reaction was terminated.

Figure 4:
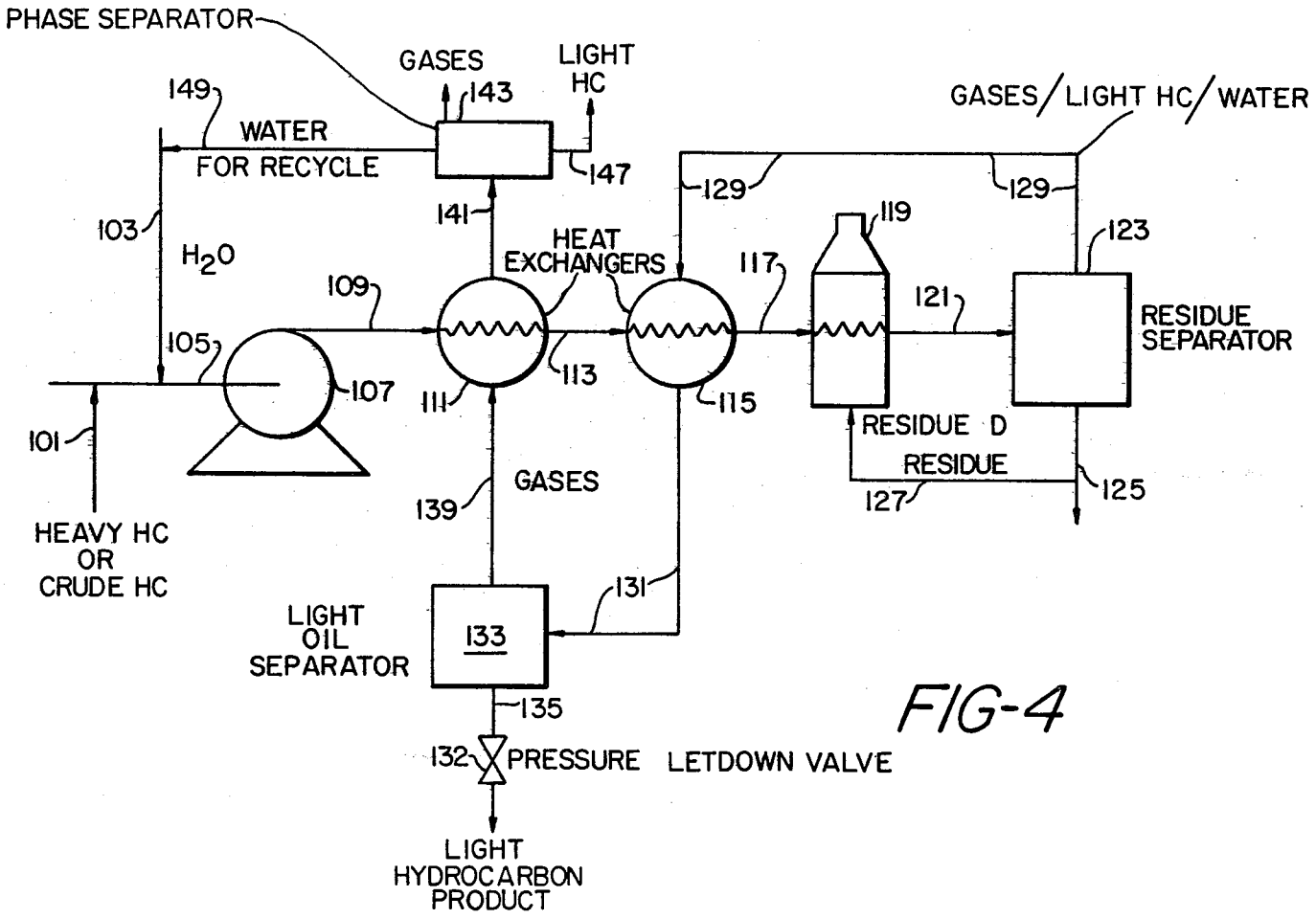
FIG. 4 is a schematic of another preferred embodiment of the process of the present invention operated in a flow reactor.

FIG. 4 illustrates a schematic of a flow reactor for continuous operation of another preferred embodiment of the present invention. A heavy hydrocarbon feedstock, such as heavy crude oil in line 101 is premixed with water in line 103 and the mixture is fed via line 105 to pump 107 which pumps mixture via lines 109 and 113 to high pressure heat exchangers 111 and 115 which may be of any convenient design and then via line 117 to high temperature preheater 119 which may conveniently be a high pressure direct-fired tubular heater. The reaction mixture from preheater 119 is passed via line 121 to residue separation unit 123. In separation unit 123, the reaction mixture is separated into a vapor stream 129 suitable for further processing and/or transportation, and containing (1) $C_1$–$C_6$ alkanes and alkenes, hydrogen sulfide, carbon dioxide and trace amounts of hydrogen, (2) light hydrocarbons, and (3) water vapor, and a residue stream 125 which may be used as fuel or at least partially recycled via line 127 to preheater 119. The gaseous stream 129 is passed through heat exchanger 115 in line 131 to light oil separator 133 wherein the light oil is removed via line 135 containing pressure let-down valve 137. The pressure let-down valve 137 may also be positioned in line 131. The gaseous alkanes, alkenes, carbon dioxide, hydrogen and water vapor removed from light oil in separator 133 via line 139 passes through heat exchanger 111 and line 141 to phase separator 143. Gases are removed from 143 via line 145. Light oil which may be present is removed via line 147. Water removed from phase separator 143 via line 149 is forwarded to water make-up line 103. The design of the separation units 123, 133 and 143 will depend on the type of heavy hydrocarbon feedstock used, the degree of restructuring desired, and other economic factors.

The first and second zones for operating the process of the present invention may be separate reactors or two reaction zones within the same reactor. The reaction conditions, e.g., temperature and pressure, water:oil ratios chosen will, of course, depend on many considerations such as the heavy hydrocarbon feedstock available and the light hydrocarbon product desired.

The following examples illustrate the present invention and are not intended to limit the same.

GENERAL EXPERIMENTAL

Description—Batch Reactor

Water was fed from a graduated cylinder to a high pressure pump (Aminco, cat. no. 46-14025) provided with a pressure gauge. Water was delivered at a uniform rate through a preheater coil heated to 410° C. by a Lindbergh electric oven into a 300 $cm^3$ stirred autoclave (from Autoclave Engineering). A special "gaspersator" magnet drive stirrer was used with a water cooling at the top. A thermocouple measured the extraction temperature while the autoclave was heated by a heating jacket controlled independently. The tubing between preheater and autoclave and release valve was heated with heating tapes controlled by a Variac variable poteniometer. A special high temperature, high pressure let down valve was used at exit. The valve was sensitive to plugging. The plugging problem was eliminated by releasing steam occasionally through the valve. A mixture of steam and light hydrocarbon was passed through a water-cooled condenser and collected in the receiver. The uncondensed material went through a buffer container, suitable for gas sampling and was collected in a collapsible balloon. The complete batch reactor was placed in an explosion proof high pressure laboratory cubicle and was operated from outside. The high pressure, high temperature batch experiments on heavy crude oil and tar sand bitumen were performed in this experiment.

Analysis of Extract, Gases and Residue

The graphite furnace method was used to determine the amount of vanadium and nickel in the light hydrocarbon stream, and atomic absorption method used for the residue. Viscosity was recorded either by New Metrec or Cannon Ubhelode instrument. Density measurement was made by a pyconometer $^1H$ and $^{13}C$ nmr spectra were recorded in deuterochloroform. For $^1H$ nmr Varian XL200 and for $^{13}C$ nmr Varian FT 80A instruments were used. Tris(acetonylacetyl)chromium [$Cr(acac)_3$] was used to allow complete relaxation of the nuclei. Electron spin resonance spectra of flowable hydrocarbons were obtained using dual cavity Varian E-12. Infrared measurement of light hydrocarbons was made in solution ($CHCl_3$) on Perkin-Elmer 239 Infrared Spectrophotometer, and of residue was made on Nicolet 7199 FT-IR. Thermogravimetric analysis (TGA) of residue was performed by Dupont 951-TGA instrument.

Molecular weight distributions of the light hydrocarbons products and the heavy hydrocarbon feed samples were determined by Gel Permeation Chromatographic techniques. The samples were dissolved in THF and eluted through $\mu$-styrogel column at ambient temperature. A differential refractometer ($\Delta$RI) was used to detect the eluting species. The molecular weight distribution (highest, peak and lowest) were obtained from retention volume. Linear aliphatic hydrocarbon standards were used for distribution of molecular weight calibration of the $\mu$-styrogel column.

Boscan heavy crude oil, tar sand bitumen and the light hydrocarbons produced therefrom and some standards (gasoline, kerosene and diesel) were analyzed by Hewlett-Packard Model No. 5880 gas chromatograph equipped with a flame ionization detector and a capillary splitter.

The range of separation for aliphatics, using a capillary gas chromatograph described above, was $C_1$ to $C_{30}$ hydrocarbons. The aromatic range was benzene to benzo(a)pyrene. Identification of peaks was achieved by comparison with standards representative of each chemical class.

A class separation into aliphatics, aromatics and polars was performed by high pressure liquid chromatography (Varian 500 HPLC equipped with an LDC Spectro Monitor III variable wavelength detector and a Valco ULCI automatic sample injector with 10 and 250 $\mu$L sampling loops). Using a 5 $\mu$m cyano bonded stationary phase (Zorban CN 4.6×250 mm from Dupont) and employing the following gradient: isocratic elution with hexane for 3 min followed by a 0–100% 1-butanol gradient in 5 min at a flow of 1 mL/min. Absorbance was measured at 254 nm. Aliphatic (alkane/alkene) fraction will not exhibit a UV absorbance at 254 nm but will elute prior to the aromatic fraction. Preparative HPLC was carried out on a 9.4×250 mm, 5$\mu$ Zorbax CN semi-preparative column. In semi-preparative separation solvent flow was 5 mL/min and detection was made at 320 nm. As much as 30 mg filtered light hydrocarbon stream in hexane could be loaded on column. The samples were filtered using a 0.45$\mu$ to remove insoluble material. Fractions obtained were further analyzed by FID capillary gas chromatography.

Separation of gases was achieved on a gas chromatograph equipped with a gas injector and TC detector using oxidized Porapak Q ($\frac{1}{8}$"×3') or 20% dimethylsulfolane on 80/100 chromosorb P ($\frac{1}{8}$"×20'; at −25° C.). GC/MS of gas samples were obtained on Finnigan 3300 (electron impact) using INCOS DATA system.

EXAMPLES 1-2

Treatment of Bitumen and Boscan Heavy Oil with Water

Athabasca tar sand bitumen (sample #81-02, substantially free of sand, supplied by Alberta Research Council) and Boscan heavy crude oil from Venezuela were used in Example 1 (runs 1-4 and in Example 2 (run 5), respectively. Generally, 60 g of heavy oil or bitumen were charged in a heated (450° C.) autoclave described in General Experimental purged with nitrogen gas. The material was heated to 410° C. usually in 10-15 minutes. During the heating period, some water was added to develop the desired pressure. Once an appropriate pressure and temperature were attained, the compressed steam at same temperature was passed at a set flow rate. The pressure was maintained by controlling let-down valve manually. Total of 200 mL water was used for the reaction. The amount of water used to develop the desired pressure varied from 12 mL to 50 mL. The extract and the condensed steam were collected in a three neck flask. Most of the light hydrocarbon was separated from the condensed steam by a separatory funnel after allowing enough time for phase separation. The remaining light hydrocarbon and condensed steam were diluted with pentane or fluorotrichloromethane and separated in a separatory funnel. Following drying over $MgSO_4$ and filtration, solvent was distilled off using a water bath at controlled temperature. The material left in the autoclave was defined as residue. The results of treatment of Boscan heavy crude oil and of tar sand bitumen with water at 410° C. and various pressures are reported in Tables I and II, respectively.

TABLE II

Comparison of Properties of Tar Sand Bitumen, and of the Light Hydrocarbons and Residue Obtained Therefrom by Treatment with $H_2O$ at 410° and Various Pressures

| | | Run #5* 3500 psi/410° C. | |
|---|---|---|---|
| Property | Bitumen | Light HC | Residue |
| API Gravity (25° C.) | 10.14 | 23.16 | — |
| Viscosity cp (25° C.) | 28,000 | 7.5 | — |
| C wt % | 83.21 | 83.42 | 80.84 |
| H | 10.44 | 10.75 | 4.24 |
| N | 0.76 | Trace | 1.61 |
| S | 4.77 | 3.51 | 6.50 |
| O | 1.2 | 1.18 | 2.5 |
| H/C Ratio | 1.49 | 1.53 | 0.62 |
| V wt ppm | 150 | 22 | 730 |
| Ni wt ppm | 55 | 9 | 520 |
| Pentane Soluble % | 72 | 72 | None |
| Toluene Soluble % | 100 | 100 | 16 |
| THF Soluble % | 100 | 100 | 30 |

*yield data for Run #1 (wgt %): 79% Light HC; 7% Gas; 13% Residue

EXAMPLES 3-4

The procedure and apparatus of Examples 1-2 is used except that tar sand bitumen (substantially free of sand) is treated with water at 2000 psig and 410° C. (Example 2) and at 1500 psig and 410° C. (Example 3). Results of Example 3 and 4 are expected to be similar to those of Example 1, Runs 3 and 4 respectively.

EXAMPLE 5

Boscan heavy crude oil of Examples 1-2 was treated with water in the flow reactor illustrated in FIG. 3. The results are reported in Table III.

TABLE I

Comparison of Properties of Boscan Heavy Oil, and the Light Hydrocarbons and Residue Obtained Therefrom by Treating Boscan Heavy Oil at 410° C. and Various Pressures

| | | Run #1 3500 psi/410° C.* | | Run #2 2000 psi/410° C.[a]** | | Run #3 2000 psi/410° C.*** | | Run #4 1500 psi/410° .C**** | |
|---|---|---|---|---|---|---|---|---|---|
| Property | Boscan Heavy Oil | Light HC | Residue | Light HC | Residue | Light HC | Residue | Light HC | Residue[c] |
| API Gravity | 10.3 | 21.8 | — | 29.1 | — | 29.0 | — | 32.1 | — |
| Viscosity C.P. | 60,000 | 7.9 | — | 5.08 | — | 4.54 | — | 2.49 | — |
| (Temp) | (22° C.) | (25° C.) | | | | | | | |
| C wt% | 81.84 | 81.73 | 83.56 | 82.59 | 85.15 | 82.86 | 84.62 | 83.42 | — |
| H | 10.41 | 10.19 | 4.56 | 11.39 | 4.25 | 11.51 | 3.88 | 11.75 | — |
| N | 0.56 | Trace | 2.53 | Trace | 1.53 | Trace | 1.88 | <0.1 | — |
| S | 5.52 | 3.99 | 6.61 | 4.03 | 6.38 | 4.0 | 6.82 | 4.1 | — |
| O | 1.25 | 0.89 | 0.92 | 0.295 | 0.878 | 0.286 | 0.760 | — | — |
| H/C Ratio | 1.51 | 1.58 | 0.65 | 1.64 | 0.59 | — | — | 1.68 | — |
| V wt ppm | 1500 | 150 | 6500 | 7.8 | 5900 | 9.4 | 6000 | 4.5 | — |
| Ni wt ppm | 100 | 4 | 600 | 1.2 | 600 | 1.3 | 580 | 3.0 | — |
| Aromatic C % | 17.9 | 20.6 | — | 20.1 | — | 20.9 | — | 20.6 | — |
| Pentane Soluble % | 78 | 100 | none | 100 | none | 100 | — | 100 | — |
| Toluene Soluble % | 100 | 100 | 7 | 100 | 1 | 100 | — | 100 | — |
| THF Soluble % | 100 | 100 | 11 | 100 | 4 | 100 | — | 100 | — |

Footnotes to Table I

*yield data for Run #1 (wgt %): 66% Light HC; 3% Gas; 24% Residue

**yield data for Run #2 (wgt %): 64.6% Light HC; 5.2% Gas; 22.2% Residue

***yield data for Run #3 (wgt %): 63.1% Light HC; 4.8% Gas; 23.1% Residue

****yield data for Run #4 (wgt %): 59.0% Light HC; 6.4% Gas; 25.2% Residue

[a]240 mL of air were present at start of Run #2.

[b]$N_2$ was present at start of Run #3.

[c]Analysis of residue is expected to be similar to that of Run #2 and 3 of Table I.

TABLE III

Results of Treatment of Boscan Heavy Crude Oil with Water in Flow Reactor at Various Temperatures and Pressures

| Property | Boscan Heavy Oil | Run #6 1500 psi/412° C.[a,b] Light HC[b] | Run #6 Residue[b] | Run #7 1500 psi/430° C.[c,d] Light HC | Run #7 Residue[e] | Run #8 1500 psi/442° C.[f,g,h] Light HC | Run #8 Residue | Run #9 2000 psi/420° C. Light HC | Run #9 Residue |
|---|---|---|---|---|---|---|---|---|---|
| API Gravity (25° C.) | 10.3 | 28.3 | — | 32.6 | — | 27.3 | — | 33.6 | — |
| Viscosity C.P. (Temp) | 60,600 (22° C.) | 11.1 | — | 4.8 | — | 5.0 (22° C.) | — | 4.5 (22° C.) | — |
| C (wt %) | 81.84 | 83.02 | 81.68 | 83.86 | — | 83.98 | — | 81.38 | 84.42 |
| H (wt %) | 10.41 | 12.01 | 8.95 | 12.05 | — | 12.06 | — | 11.93 | 8.71 |
| N (wt %) | 0.56 | na | na | na | — | na | — | na | — |
| S (wt %) | 5.52 | 4.09 | 5.69 | 4.6 | — | 3.92 | — | 3.71 | — |
| O (wt %) | 1.25 | — | — | — | — | na | — | na | — |
| H/C Ratio | 1.51 | 1.74 | 1.31 | 1.72 | — | 1.72 | — | 1.76 | 0.81 |
| V (wt ppm) | 1500 | 28.6 | — | 22.2 | — | 16.6 | — | 23.3 | — |
| Ni (wt ppm) | 100 | 1.4 | — | 3.8 | — | 1.5 | — | 1.0 | — |
| Pentane Soluble (%) | 78 | 100 | 60.5 | 100 | 49.9 | 100 | — | 100 | — |
| Toluene Soluble (%) | 100 | 100 | — | 100 | na | 100 | — | 100 | — |
| THF Soluble (%) | 100 | 100 | — | 100 | na | 100 | — | 100 | — |

[a]Experimental Conditions: Heavy Oil Input Rate (mL/min) = 2.82; Total Run Time = 107 min; $H_2O$/Oil Ratio (v/v) = 3.5
[b]Yield Results (wgt %): 41.6% Light HC; 1.0% Gas; 58.4% Residue
[c]Experimental conditions: Heavy Oil Input Rate = 5.3 mL/min; Total Run Time = 90 min; $H_2O$/Oil Ratio (v/v) = 1.3
[d]Yield results (wgt %): 57.6% Light HC; 1.0% Gas; 41.4% Residue
[e]Residue stream was discharged from autoclave 3 times during Run #7
[f]Experimental Conditions: Heavy Oil Input Rate (mL/min) = Total Run Time (min) = 62 $H_2O$/Oil Ratio (v/v) = 1.4
[g]Yield Results (wgt %): 59.4% Light HC; 6.5% Gas; 34.1% Residue
[h]After completion of Run #8, the residue was stripped with steam and overall yield results (wgt %) were: 67.1% Light HC; 6.5% Gas (unchanged); 26.5% Residue
[i]Experimental conditions: Heavy Oil Input Rate = 4.7 mL/min; Total Run Time = 70 min; $H_2O$/Oil Ratio (v/v) = 1.4
[j]Yield Results (wgt %): 56.5% Light HC; 3.0% Gas; 40.5% Residue

EXAMPLE 6

The tar sand bitumen of Examples 1–2 is treated with water in the flow reactor illustrated in FIG. 3 in accordance with procedure of Example 5. Results similar to those reported in Example 5 are expected.

EXAMPLE 7

Light Hydrocarbon products were obtained by treatment of Boscan heavy crude oil with water in semi-continuous reactor of general experimental and in accordance with procedure of Example 1 at 410° C. and at pressures from atmospheric to 3500 psig (runs 1, 2, and 4 of Example 1 and other runs not reported herein). The API gravity and viscosity of these Light Hydrocarbon products were measured and are plotted in FIG. 1. The results are summarized in Table IV.

TABLE IV

Comparison of API Gravity and Viscosity of Boscan Heavy Oil

| Property | Boscan Heavy Oil | Run # #1 3500 psi, 410° C. | #1 2500 psi, 410° C. | #2 2000 psi, 410° C. | #4 1500 psi, 410° C. | #4 1000 psi, 410° C. |
|---|---|---|---|---|---|---|
| API Gravity[a] | 10.3 | 21.8 | 26.5 | 29.1 | 32.1 | 31.0 |
| Viscosity (25° C.) cp | 60,600 (at 22° C.) | 7.9 | 6.46 | 5.08 | 2.49 | 3.44 |

[a]API Gravity = $\frac{141.5}{\text{Spec. Gravity}} - 131.5$

EXAMPLE 8

The light hydrocarbon product from Run #4 of Table 1 was subjected to atmospheric distillation followed by vacuum distillation at successively lower pressures. The results are reported in Table V. Similar results are expected from distillation of Light Hydrocarbon product obtained from treatment of tar sand bitumen at 410° C./1500 psig.

TABLE V

Results from Distillation of Boscan Heavy Crude Oil and the Light Hydrocarbon Product of Run #4 of Table 1

| Fraction Identity | Boiling Range[a] (°C.) | Boscan HCO[b] (wt %) | Light HC[c] (wt %) |
|---|---|---|---|
| Naphtha | 35–90[d] | 3.15 | 54.85 |
| Light Gas Oil | 190–260[d] | 5.70 | 21.76 |
| Heavy Gas Oil | 260–343[e] | 6.35 | 19.02 |
| | 343–530[e] | 27.70 | 4.37 |
| | >530[e] | | |

Footnotes to Table V
[a]Standard Boiling Points (corrected)
[b]Boscan Heavy Crude Oil used in Example 1–2
[c]Light Hydrocarbon Product from Run #4 of Table 1 (410° C./1500 psig)
[d]Distilled at atmospheric pressure
[e]Distilled at reduced pressure; boiling points corrected to one atmospheric pressure

COMPARATIVE EXAMPLE 9

This example illustrates treatment of Boscan heavy crude oil with water in an apparatus similar to that disclosed in U.S. Pat. No. 2,135,332 (Gary). The apparatus and procedure of FIG. 3 were used with the modification detailed herein below to provide for reduction of temperature and pressure to ambient before separation of residue from reaction mixture from which light hydrocarbon product is obtained.

In a typical experiment, Boscan heavy oil and water were pumped into a tubular reactor. The oil/$H_2O$ ratio and pump rate were varied. The tubular reactor 51 was heated to about ~465°–470° C. in a fluidized sand bath. The mixture product formed was directly transferred from tubular reactor 31 to a condensing flask 77 via line 69 through pressure control valve 75. Condensed oil and $H_2O$ were worked up in two steps: first, water was distilled off in vacuum. Second, the oil obtained was distilled according to ASTM type distillation methods. The results for a series of experiments wherein residence time in tubular heater 51 of FIG. 3 was varied are summarized in Table VI.

TABLE VI

Conversion of Boscan at 465° C.–470° C., 2000 psi in a Continuous Flow Tubular Reactor 51 of FIG. 3

| Residence Time Min, Sec. | Light Oil[a] wt % | Gas wt % |
|---|---|---|
| 6, 35[b] | 76 | 1.25 |
| 1, 40[c] | 53.5 | 1.00 |
| 1, 15 | 49.6 | 0.8 |
| 0, 30 | 44.9 | 0.6 |
| Virgin Boscan | 37.7[d] | — |

[a]Processed oil distilled after temperature and pressure letdown to ambient according to ASTM type method. Max. pot temp. 325° C., heating rate 2° C./min. Max. distillate temperature 225° C., Vac. 0.1 mm.
[b]At 6 min. 35 sec. residence time all the residue which might have been coke stayed in the coil. Plugging occurred. Reaction was terminated after 100 g of Boscan heavy oil was fed to tubular reactor 51 (reactor volume equal to 73 g of oil).
[c]Slow build-up of coke formation in the tubular reactor.
[d]Vacuum distillate.

Two other experiments were run in the continuous flow tubular reactor 51 of FIG. 3 under identical conditions to those detailed above, except that the pressure was 2500 and 3500 psi, respectively. In both experiments, coke formation occurred thereby clogging the tubular reactor and the reaction was terminated after 100 g of Boscan heavy crude oil had been fed to tubular reactor 51.

We claim:

1. A process for converting heavy hydrocarbons into light hydrocarbons which comprises:

(a) contacting, in a first zone, heavy hydrocarbons having an API gravity at 25° C. of less than about 20 with a liquid comprising water, in the absence of externally added catalyst and hydrogen, at a temperature between about 380° C.–480° C. and at a pressure between about 5000 kPa and about 5,000 kPa (about 2175 psig, about 148 atm), and for a time sufficient to form a uniform mixture;

(b) forwarding the uniform mixture to a second zone while maintaining the temperature and pressure conditions of the first zone;

(c) maintaining the uniform mixture in the second zone under the temperature and pressure conditions of the first zone, in the absence of externally added catalyst and hydrogen, for a time sufficient to separate the uniform mixture into a residue and a phase comprising light hydrocarbons, gas and water;

(d) withdrawing the residue and said phase from the second zone;

(e) separating said phase into a gaseous product, a liquid comprising water and light hydrocarbon product having an API gravity at 25° C. of greater than about 20 and substantially free of vanadium and nickel values; and (f) recovering said light hydrocarbon product.

2. The process of claim 1 wherein the temperature of the first and second zones is between about 400° and about 470° C. and the pressure of the first and second zones is between about 7,000 kPa and about 13,000 kPa.

3. The process of claim 1 wherein the first and second zones comprise a flow reactor.

4. The process of claim 1 wherein the light hydrocarbon product has a total vanadium and nickel content of less than about 50 ppm.

5. The process of claim 1 wherein the heavy hydrocarbons have a viscosity at 25° C. in the range of about 1,000 cp to about 100,000 cp and wherein the light hydrocarbon product has a viscosity at 25° C. of less than about 10 cp.

6. The process of claim 1 wherein in step (e) said phase is separated by reducing the pressure and temperature to values sufficient to allow separation of said phase into the gaseous product, the liquid comprising water and said light hydrocarbon product.

7. A process for converting heavy hydrocarbons into light hydrocarbons which comprises:

(a) contacting, in a first zone, heavy hydrocarbons having an API gravity at 25° C. of less than about 20 and a total vanadium and nickel content between about 1000 and 2000 ppm with a liquid comprising water, in the absence of externally added catalyst and hydrogen, at a temperature between about 380° C. and about 480° C., about 5000 kPa and about 15,000 kPa for a time sufficient to form a uniform mixture;

(b) forwarding the uniform mixture to a second zone while maintaining the temperature and pressure conditions of the first zone;

(c) maintaining the uniform mixture in the second zone under the temperature and pressure conditions of the first zone, in the absence of externally added catalyst and hydrogen, for a time sufficient to separate the uniform mixture into a residue and a phase comprising light hydrocarbons, gas and water;

(d) withdrawing the residue and said phase from the second zone;

(e) separating said phase into a gaseous product, a liquid comprising water, and a light hydrocarbon product having an API gravity at 25° C. of between about 20 and 40 and substantially free of vanadium and nickel values; and (f) recovering said light hydrocarbon product.

8. The process of claim 7 wherein the temperature of the first and second zones is between about 400° and 470° C. and the pressure of the first and second zones is between about 7,000 kPa and 13,000 kPa.

9. The process of claim 7 wherein the heavy hydrocarbons have a viscosity at 25° C. of at least about 60,000 cp and the light hydrocarbon product has a viscosity at 25° C. less than about 10 cp.

10. The process of claim 7 wherein the first and second zones form a flow reactor.

11. The process of claim 10 wherein the light hydrocarbon product has a total vanadium and nickel content of less than about 30 ppm.

12. The process of claim 10 wherein the light hydrocarbon product has a total vanadium and nickel content of less than about 30 ppm.

13. The process of claim 10 wherein the gaseous product is less than 10 percent by weight of the heavy hydrocarbon stream.

14. The process of claim 7 wherein in step (e) said phase is separated by reducing the pressure and temperature to values sufficient to allow separation of said phase into the gaseous product, the liquid comprising water and said light hydrocarbon product.

15. A process for converting heavy hydrocarbons into light hydrocarbons which comprises:

(a) contacting, in a first zone, heavy hydrocarbons having an API gravity at 25° C. of less than about 20 and a total vanadium and nickel content of between about 100 and 1000 ppm with a liquid comprising water, in the absence of externally added catalyst and hydrogen, at a temperature between about 380° and 480° C. and at a pressure between about 5000 kPa and about 15,000 kPa for a time sufficient to produce a uniform mixture;

(b) forwarding the uniform mixture to a second zone while maintaining the temperature and pressure conditions of the first zone;

(c) maintaining the uniform mixture in the second zone under the temperature and pressure conditions of the first zone, in the absence of externally added catalyst and hydrogen, for a time sufficient to separate the uniform mixture into a residue and a phase comprising light hydrocarbons, gas and water;

(d) withdrawing the residue and said phase from the second zone;

(e) separating said phase into a gaseous product, a liquid comprising water, and a light hydrocarbon product having an API gravity at 25° C. of between about 20 and 40 and substantially free of vanadium and nickel values; and (f) recovering said light hydrocarbon product.

16. The process of claim 15 wherein the temperature of the first and second zones is between about 400° and 470° C. and the pressure of the first and second zones is between about 7,000 kPa and about 13,000 kPa.

17. The process of claim 15 wherein the heavy hydrocarbons have a viscosity at 25° C. of at least about 30,000 cp and the light hydrocarbon product has a viscosity at 25° C. less than about 10 cp.

18. The process of claim 15 wherein the first and second zones comprise a flow reactor.

19. The process of claim 18 wherein the light hydrocarbon stream has a total vanadium and nickel content less than about 50 ppm.

20. The process of claim 18 wherein the light hydrocarbon stream has a total vanadium and nickel content of less than about 30 ppm.

21. The process of claim 18 wherein the gaseous stream is less than 10 percent by weight of the heavy hydrocarbon stream.

22. The process of claim 18 wherein in step (e) said phase is separated by reducing the pressure and temperature to values sufficient to allow separation of said phase into the gaseous product, the liquid comprising water and said light hydrocarbon product.

* * * * *

UNITED STATES PATENT AND TRADEMARK OFFICE

CERTIFICATE OF CORRECTION

PATENT NO. : 4,446,012

DATED : May 1, 1984

INVENTOR(S) : A. K. S. Murthy, et al.

It is certified that error appears in the above-identified patent and that said Letters Patent are hereby corrected as shown below:

Column 8, Line 36, "hydrooarbons" should read --hydrocarbons--

Column 17, Line 34, second 5,000 should read "15,000 kPa"

Signed and Sealed this

*Twelfth* Day of *February 1985*

[SEAL]

*Attest:*

DONALD J. QUIGG

*Attesting Officer* *Acting Commissioner of Patents and Trademarks*